US009642419B1

(12) United States Patent
Marrale

(10) Patent No.: US 9,642,419 B1
(45) Date of Patent: May 9, 2017

(54) SHOELACE SECURING APPARATUS

(71) Applicant: Jasmyn Marrale, Brooklyn, NY (US)

(72) Inventor: Jasmyn Marrale, Brooklyn, NY (US)

( * ) Notice: Subject to any disclaimer, the term of this patent is extended or adjusted under 35 U.S.C. 154(b) by 0 days.

(21) Appl. No.: 15/212,543

(22) Filed: Jul. 18, 2016

(51) Int. Cl.
*A43C 7/00* (2006.01)
*A43C 7/04* (2006.01)
*A44B 18/00* (2006.01)

(52) U.S. Cl.
CPC ..... *A43C 7/04* (2013.01); *A43C 7/005* (2013.01); *A44B 18/0069* (2013.01)

(58) Field of Classification Search
CPC ..... A43C 7/04; A43C 7/005; A44B 18/0069
See application file for complete search history.

(56) References Cited

U.S. PATENT DOCUMENTS 4,553,293 A * 11/1985 Blum ..... A43B 1/0081 24/306
5,022,127 A * 6/1991 Ang ..... A43C 7/005 24/712.2
5,372,510 A * 12/1994 Stanfield ..... G09B 19/0076 132/279
5,566,477 A * 10/1996 Mathis ..... A43B 3/0078 36/100
5,649,342 A * 7/1997 D'Andrade ..... A43C 7/005 24/712.2
5,778,500 A 7/1998 Illingworth
5,913,483 A 6/1999 Polk
6,000,111 A * 12/1999 Deskins ..... A43C 7/02 24/442
6,260,246 B1 * 7/2001 Lampkins ..... A43C 7/005 24/712.1
6,588,078 B2 * 7/2003 Writt ..... A43B 3/0031 24/712.2
6,601,323 B2 * 8/2003 Tsujino ..... A43C 7/02 24/712.3
7,003,903 B2 2/2006 Johnson
7,044,508 B2 * 5/2006 Burns ..... D04G 5/00 289/1.5
7,334,353 B2 * 2/2008 Lampkins ..... A43C 7/005 24/712.1
7,398,580 B1 * 7/2008 Miller, III ..... A43C 7/00 24/712.2
7,640,640 B1 * 1/2010 Watkins ..... A43C 7/02 24/712.3
8,782,860 B2 * 7/2014 Rogers ..... A43C 7/005 24/329

(Continued)

*Primary Examiner* — Victor Batson
*Assistant Examiner* — David Upchurch
(74) *Attorney, Agent, or Firm* — Stevenson IP, LLC

(57) ABSTRACT

A shoelace securing apparatus including a clamping member having an upper portion, a lower portion, and a middle portion disposed between the upper portion and the lower portion. A pair of parallel grooves is disposed within an interior surface of the middle portion. Each of a right pair of lips and a left pair of lips of a plurality of a pair of convexly curved lips is disposed on the interior surface of the middle portion proximal each of a right edge and a left edge, respectively, of the middle portion. A plurality of teeth members is disposed on each of the right pair of lips and the left pair of lips. Each of a right end portion of a shoelace and a left end portion of the shoelace is disposed within each of the pair of parallel grooves and engaged between one of a pair of adjacent teeth members.

2 Claims, 3 Drawing Sheets

(56) References Cited

U.S. PATENT DOCUMENTS

| | | | | |
|---|---|---|---|---|
| 2008/0301918 | A1* | 12/2008 | Tal | A43C 7/005<br>24/712.2 |
| 2013/0220872 | A1* | 8/2013 | Stiehl | B65H 75/285<br>206/577 |
| 2014/0020263 | A1* | 1/2014 | Theuvenet | A43B 3/0005<br>36/50.1 |

* cited by examiner

SHOELACE SECURING APPARATUS

BACKGROUND OF THE INVENTION

Various types of knot securing devices are known in the prior art. However, what has been needed is a shoelace securing apparatus including a clamping member having an upper portion, a lower portion, and a middle portion disposed between the upper portion and the lower portion. What has been further needed is for a pair of parallel grooves to be disposed within an interior surface of the middle portion, and for each of a right pair of lips and a left pair of lips of a plurality of a pair of convexly curved lips to be disposed on the interior surface of the middle portion proximal each of a right edge and a left edge, respectively, of the middle portion. Lastly, what has been needed is a plurality of teeth members disposed on each of the right pair of lips and the left pair of lips such that each of a right end portion of a shoelace and a left end portion of the shoelace is disposed within each of the pair of parallel grooves and removably engaged between one of a pair of adjacent teeth members. The shoelace securing apparatus is particularly helpful for smaller children who have not yet mastered the art of shoelace tying, since the plurality of teeth members securely engage the shoelace and help to keep the shoelace tied.

FIELD OF THE INVENTION

The present invention relates to knot securing devices, and more particularly, to shoelace securing apparatus.

SUMMARY OF THE INVENTION

The general purpose of the present shoelace securing apparatus, described subsequently in greater detail, is to provide a shoelace securing apparatus which has many novel features that result in a shoelace securing apparatus which is not anticipated, rendered obvious, suggested, or even implied by prior art, either alone or in combination thereof.

To accomplish this, the present shoelace securing apparatus includes a single continuous inverted substantially C-shaped clamping member having a substantially rectangular upper portion, a substantially rectangular lower portion, and a substantially semicircular middle portion continuously disposed between the upper portion and the lower portion. Each of the upper portion, the lower portion, and the middle portion has an exterior surface, an interior surface, a right edge, and a left edge, and each of the upper portion and the lower portion has a front edge. A pair of parallel grooves is continuously disposed within the interior surface of the middle portion of the clamping member from proximal the right edge to proximal the left edge.

The shoelace securing apparatus further includes a plurality of a pair of convexly curved lips including a right pair of lips and a left pair of lips. Each of the right pair of lips and the left pair of lips has an upper lip and a lower lip, and each of the upper lip and the lower lip has an external surface and an internal surface. The upper lip of each of the right pair of lips and the left pair of lips is downwardly disposed on the interior surface of the middle portion of the clamping member proximal each of the right edge and the left edge, respectively, and the lower lip of each of the right pair of lips and the left pair of lips is upwardly disposed on the interior surface of the middle portion of the clamping member proximal each of the right edge and the left edge, respectively. A plurality of teeth members is continuously and linearly disposed from the internal surface of the upper lip of each of the right pair of lips and the left pair of lips to the internal surface of the lower lip of each of the right pair of lips and the left pair of lips, respectively, along the interior surface of the middle portion of the clamping member.

A first strip of a pair of interconnectable hook and loop fasteners is disposed on the interior surface of the upper portion of the clamping member proximal the front edge, and a second strip of the pair of interconnectable hook and loop fasteners is disposed on the interior surface of the lower portion of the clamping member proximal the front edge. The pair of hook and loop fasteners is configured to secure the upper portion of the clamping member to the lower portion of the clamping member.

The clamping member has an open position and an alternate closed position. The clamping member is in the open position when the upper portion of the clamping member is substantially perpendicularly disposed to the lower portion of the clamping member. The clamping member is in the closed position when the upper portion is secured to the lower portion. Additionally, each of a right end portion of a shoelace and a left end portion of the shoelace is disposed within each of the pair of parallel grooves and removably engaged between one of a pair of adjacent teeth members such that each of a right end and a left end of the shoelace is disposed outside the clamping member proximal the right pair of lips and the left pair of lips, respectively. The clamping member is removably disposed atop an upper area of one of a pair of shoes when each of the right end portion of the shoelace and the left end portion of the shoelace is disposed within each of the pair of parallel grooves. The plurality of teeth members is configured to selectively tighten around each of the right end portion and the left end portion of the shoelace when each of the right end and the left end of the shoelace is pulled inward toward the clamping member in order to prevent the shoelace from becoming untied.

The shoelace securing apparatus optionally includes a substantially ovular indentation disposed on the exterior surface of the upper portion of the clamping member adjacent to the front edge. The indentation is structured to provide a user with a more secure gripping surface on the clamping member.

Thus has been broadly outlined the more important features of the present shoelace securing apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
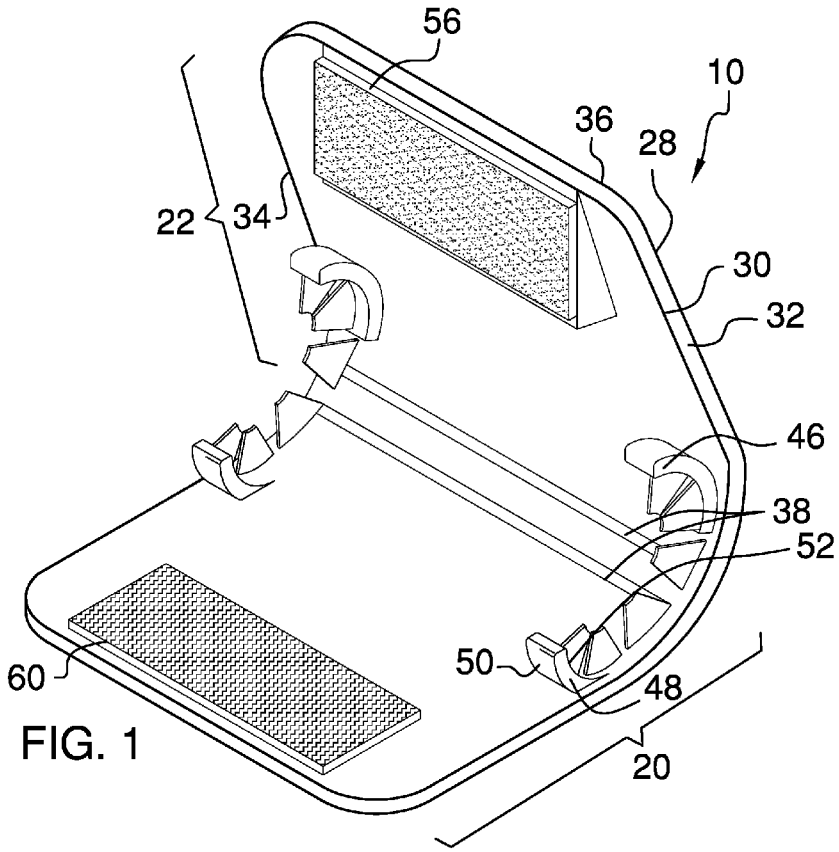
FIG. 1 is a front isometric view.
Figure 2:
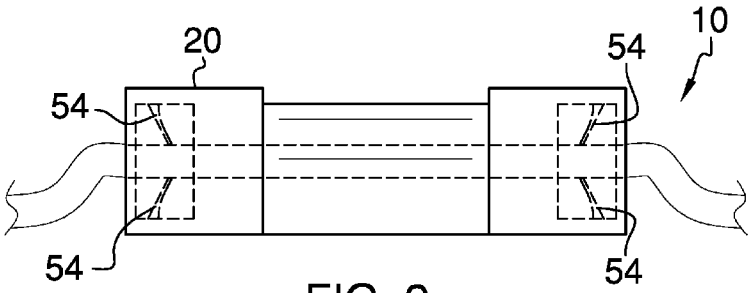
FIG. 2 is a rear elevation view.
Figure 3:
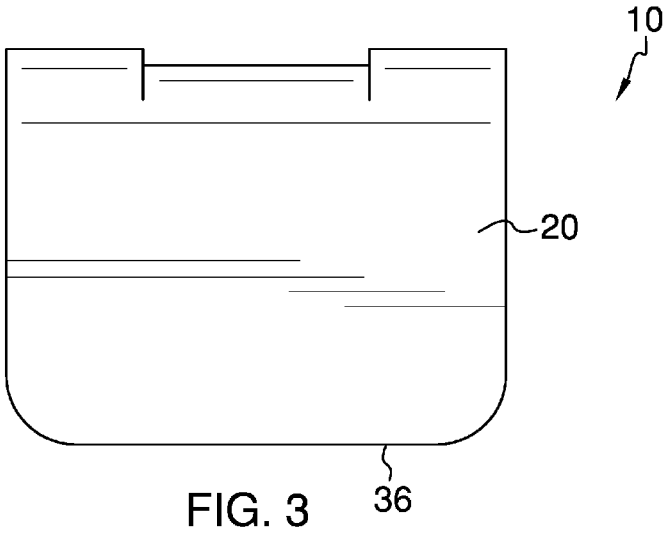
FIG. 3 is a bottom plan view.
Figure 4:
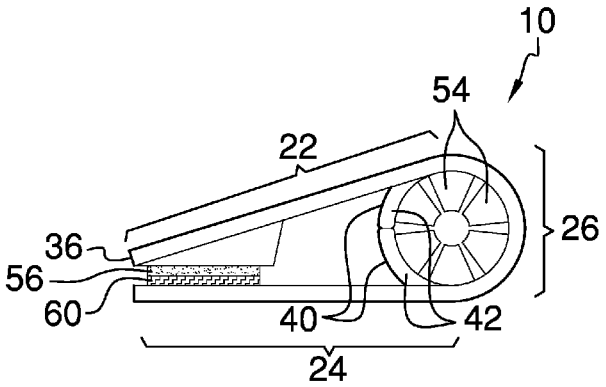
FIG. 4 is a side elevation view showing a clamping member in a closed position.
Figure 5:
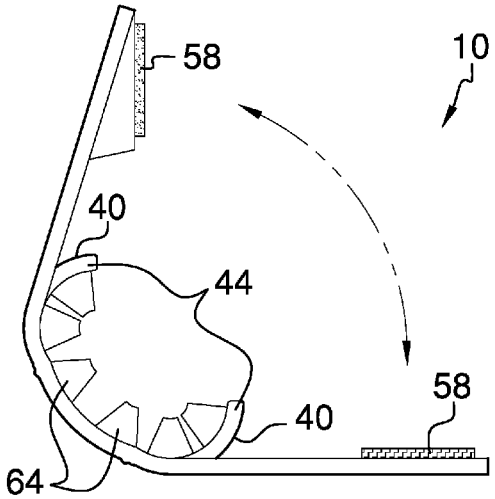
FIG. 5 is a side elevation view the clamping member in an open position.
Figure 6:
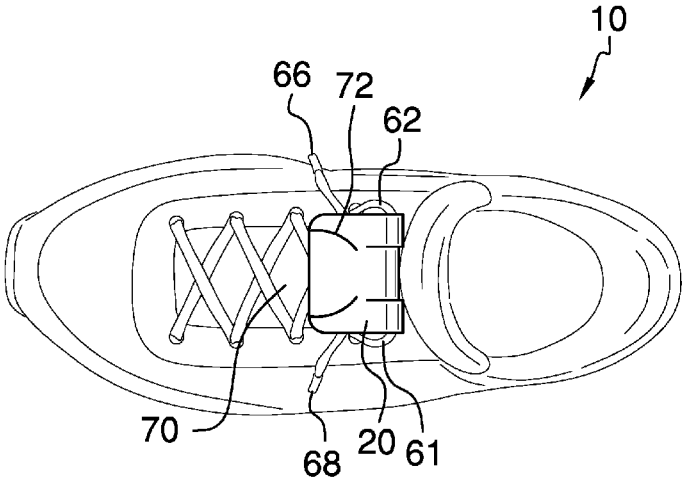
FIG. 6 is an in use view.

With reference now to the drawings, and in particular FIGS. 1 through 6 thereof, an example of the instant shoelace securing apparatus employing the principles and concepts of the present shoelace securing apparatus and generally designated by the reference number 10 will be described.

Referring to FIGS. 1 through 6 the present shoelace securing apparatus 10 is illustrated. The shoelace securing apparatus 10 includes a single continuous inverted substantially C-shaped clamping member 20 having a substantially rectangular upper portion 22, a substantially rectangular lower portion 24, and a substantially semicircular middle portion 26 continuously disposed between the upper portion 22 and the lower portion 24. Each of the upper portion 22, the lower portion 24, and the middle portion 26 has an exterior surface 28, an interior surface 30, a right edge 32, and a left edge 34; and each of the upper portion 22 and the lower portion 24 has a front edge 36. A pair of parallel grooves 38 is continuously disposed within the interior surface 30 of the middle portion 26 of the clamping member 20 from proximal the right edge 32 to proximal the left edge 34.

The shoelace securing apparatus 10 further includes a plurality of a pair of convexly curved lips 40 including a right pair of lips 42 and a left pair of lips 44. Each of the right pair of lips 42 and the left pair of lips 44 has an upper lip 46 and a lower lip 48, and each of the upper lip 46 and the lower lip 48 has an external surface 50 and an internal surface 52. The upper lip 46 of each of the right pair of lips 42 and the left pair of lips 44 is downwardly disposed on the interior surface 30 of the middle portion 26 of the clamping member 20 proximal each of the right edge 32 and the left edge 34, respectively, and the lower lip 48 of each of the right pair of lips 42 and the left pair of lips 44 is upwardly disposed on the interior surface 30 of the middle portion 26 of the clamping member 20 proximal each of the right edge 32 and the left edge 34, respectively. A plurality of teeth members 54 is continuously and linearly disposed from the internal surface 52 of the upper lip 46 of each of the right pair of lips 42 and the left pair of lips 44 to the internal surface 52 of the lower lip 48 of each of the right pair of lips 42 and the left pair of lips 44, respectively, along the interior surface 30 of the middle portion 26 of the clamping member 20.

A first strip 56 of a pair of interconnectable hook and loop fasteners 58 is disposed on the interior surface 30 of the upper portion 22 of the clamping member 20 proximal the front edge 36, and a second strip 60 of the pair of interconnectable hook and loop fasteners 58 is disposed on the interior surface 30 of the lower portion 24 of the clamping member 20 proximal the front edge 36. The pair of hook and loop fasteners 58 is configured to secure the upper portion 22 of the clamping member 20 to the lower portion 24 of the clamping member 20.

The clamping member 20 has an open position and an alternate closed position. The clamping member 20 is in the open position when the upper portion 22 of the clamping member 20 is substantially perpendicularly disposed to the lower portion 24 of the clamping member 20. The clamping member 20 is in the closed position when the upper portion 22 is secured to the lower portion 24. Additionally, each of a right end portion of a shoelace 61 and a left end portion of the shoelace 62 is disposed within each of the pair of parallel grooves 38 and removably engaged between one of a pair of adjacent teeth members 64 such that each of a right end 66 and a left end 68 of the shoelace is disposed outside the clamping member 20 proximal the right pair of lips 42 and the left pair of lips 44, respectively. The clamping member 20 is removably disposed atop an upper area 70 of one of a pair of shoes when each of the right end portion of the shoelace 61 and the left end portion of the shoelace 62 is disposed within each of the pair of parallel grooves 38.

The shoelace securing apparatus 10 optionally includes a substantially ovular indentation 72 disposed on the exterior surface 28 of the upper portion 22 of the clamping member 20 adjacent to the front edge 36.

What is claimed is:

1. A shoelace securing apparatus comprising:

a single continuous inverted substantially C-shaped clamping member having a substantially rectangular upper portion, a substantially rectangular lower portion, and a substantially semicircular middle portion continuously disposed between the upper portion and the lower portion, wherein each of the upper portion, the lower portion, and the middle portion has an exterior surface, an interior surface, a right edge, and a left edge, wherein each of the upper portion and the lower portion has a front edge;

a pair of parallel grooves continuously disposed within the interior surface of the middle portion of the clamping member from proximal the right edge to proximal the left edge;

a plurality of a pair of convexly curved lips comprising a right pair of lips and a left pair of lips, each of the right pair of lips and the left pair of lips having an upper lip and a lower lip, wherein each of the upper lip and the lower lip has an external surface and an internal surface, wherein the upper lip of each of the right pair of lips and the left pair of lips is downwardly disposed on the interior surface of the middle portion of the clamping member proximal each of the right edge and the left edge, respectively, and the lower lip of each of the right pair of lips and the left pair of lips is upwardly disposed on the interior surface of the middle portion of the clamping member proximal each of the right edge and the left edge, respectively;

a plurality of teeth members continuously and linearly disposed from the internal surface of the upper lip of each of the right pair of lips and the left pair of lips to the internal surface of the lower lip of each of the right pair of lips and the left pair of lips, respectively, along the interior surface of the middle portion of the clamping member; and a pair of interconnectable hook and loop fasteners comprising a first strip and a second strip, wherein the first strip is disposed on the interior surface of the upper portion of the clamping member proximal the front edge and the second strip is disposed on the interior surface of the lower portion of the clamping member proximal the front edge, wherein the pair of hook and loop fasteners is configured to secure the upper portion of the clamping member to the lower portion of the clamping member;

wherein the clamping member has an open position and an alternate closed position;

wherein the clamping member is in the open position when the upper portion of the clamping member is substantially perpendicularly disposed to the lower portion of the clamping member;

wherein the clamping member is in the closed position when the upper portion is secured to the lower portion;

wherein each of a right end portion of a shoelace and a left end portion of the shoelace is disposed within each of the pair of parallel grooves and removably engaged between one of a pair of adjacent teeth members such that each of a right end and a left end of the shoelace is disposed outside the clamping member proximal the right pair of lips and the left pair of lips, respectively;

wherein the clamping member is removably disposed atop an upper area of one of a pair of shoes when each of the right end portion of the shoelace and the left end portion of the shoelace is disposed within each of the pair of parallel grooves.

2. The shoelace securing apparatus of claim 1 further comprising a substantially ovular indentation disposed on the exterior surface of the upper portion of the clamping member adjacent to the front edge.

* * * * *